US008192111B2

(12) United States Patent
Zimmel

(10) Patent No.: US 8,192,111 B2
(45) Date of Patent: Jun. 5, 2012

(54) BOOT FOR GEOSYNTHETIC LAYER

(75) Inventor: Edward J. Zimmel, Magnolia, TX (US)

(73) Assignee: GSE Lining Technology, Inc., Houston, TX (US)

( * ) Notice: Subject to any disclaimer, the term of this patent is extended or adjusted under 35 U.S.C. 154(b) by 280 days.

(21) Appl. No.: 12/468,949

(22) Filed: May 20, 2009

(65) Prior Publication Data

US 2010/0296878 A1 Nov. 25, 2010

(51) Int. Cl.
*B09B 1/00* (2006.01)
*E02D 31/02* (2006.01)

(52) U.S. Cl. ..... 405/129.57; 405/129.7; 405/129.85; 277/634; 403/50

(58) Field of Classification Search ..... 405/129.45–129.95; 277/634; 285/226; 403/50, 51
See application file for complete search history.

(56) References Cited

U.S. PATENT DOCUMENTS

| | | | | |
|---|---|---|---|---|
| 4,278,115 | A * | 7/1981 | Briles et al. | 138/89 |
| 4,809,866 | A * | 3/1989 | Crocker | 141/86 |
| 5,140,848 | A * | 8/1992 | Spencer | 73/46 |
| 5,211,428 | A * | 5/1993 | Emerson et al. | 405/129.85 |
| 5,615,526 | A | 4/1997 | Palmer et al. | |
| 6,213,685 | B1 * | 4/2001 | Ingalls | 405/129.7 |
| 6,478,309 | B1 * | 11/2002 | Miyamoto et al. | 277/634 |
| 7,357,601 | B2 * | 4/2008 | Howard | 405/129.95 |
| 7,398,798 | B2 * | 7/2008 | Ostan et al. | 138/121 |
| 2003/0047883 | A1 * | 3/2003 | Imazu et al. | 277/634 |
| 2004/0200842 | A1 * | 10/2004 | Low et al. | 220/495.01 |
| 2007/0104540 | A1 * | 5/2007 | Howard | 405/128.25 |
| 2008/0310920 | A1 * | 12/2008 | Allen et al. | 405/52 |

FOREIGN PATENT DOCUMENTS

| | | |
|---|---|---|
| JP | 11-303047 | 11/1999 |
| JP | 2002-226984 | 8/2002 |
| JP | 2004-324045 | 11/2004 |
| WO | WO 2007-016672 | 2/2007 |

* cited by examiner

*Primary Examiner* — Frederick L Lagman
(74) *Attorney, Agent, or Firm* — Wood, Phillips, Katz, Clark & Mortimer

(57) ABSTRACT

A boot for attaching a geosynthetic layer to a vertical member in a soil, where the geosynthetic layer extends substantially horizontally outwardly from the vertical member. The boot includes a stack of flexible rings. Each ring has an inner edge defining a center opening larger than the horizontal cross section of the vertical member and an outer edge, and is secured around its inner edge to the inner edge of a ring adjacent one side and around its outer edge to the outer edge of a ring adjacent its other side. The bottom ring of the stack of rings is adapted to secure to the geosynthetic layer. A securement ring is secured around the top ring of the stack of rings and has a center opening adapted to be secured to the vertical member.

20 Claims, 2 Drawing Sheets

BOOT FOR GEOSYNTHETIC LAYER

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention is directed toward earthen structures with geosynthetic layers, and particularly toward the placement of geomembranes around vertical members in earthen structures.

BACKGROUND OF THE INVENTION AND TECHNICAL PROBLEMS POSED BY THE PRIOR ART

Geotechnical engineering and the usage of geosynthetic materials are very common in today's civil engineering marketplace. One of the most common geosynthetic materials available today are waterproofing products. Waterproofing products generally include geomembranes which are located in different layers of the earthen structure. Such geomembranes are laid on the top surface of, for example, a landfill, with a selected amount of landfill material then placed over the geomembrane layer, followed by another geomembrane, then more landfill material, etc. Such geomembranes are used for a broad variety of applications, with common applications including waterproofing layers in waste storage facilities, gas barrier layers in waste storage facilities, the use of a geomembrane drainage material for waterproofing in water and wastewater storage and treatment facilities, the use of geosynthetic drainage layers in roadway, rail and transportation applications and many others.

Waste collection sites are, of course, one well known type of geotechnical construction site, and are unavoidably required in today's societal structures. Such sites can require large amounts of valuable land, particularly in urban areas where land is most in demand. Also, while desirable uses can be made of such lands (for example, golf courses have been built on such sites), such desirable uses typically have to wait until the land is no longer being used for collect further waste and the often high pile of waste has stabilized. While use and stabilization of such sites can take many years, there is nevertheless a desire to have that accomplished as quickly as possible, not only to increase the safety of those who might have to be at the site but also to allow for the desired use of others (for example, golfers) and to enhance the environment of those who live in the area as soon as is reasonably possible.

Further, in many sites in which geomembranes are used, vertical members extend into the earth for a variety of reasons, such as piles with pile caps to support structures in or above the earth, and vertical pipes in landfills (e.g., to facilitate flow of leachate/liquid within the landfill, or to vent gases from the landfill). However, since the earth can shift and settle around such vertical members, it can be difficult to provide the proper construction around those members. For example, if the geomembranes are secured to the vertical members, shifting of the earth around those members can strain and tear the geomembranes, hindering their ability to provide the desired filtering and barrier in those locations. On the other hand, if the geomembranes are laid so as to be able to freely move relative to the vertical members, the geomembranes may not be damaged by shifting of the earth, but gaps are inevitably present around the vertical members which similarly will hinder the ability to filter and/or block fluid flow around the members.

The present invention is directed toward overcoming one or more of the problems set forth above.

SUMMARY OF THE INVENTION

In one aspect of the present invention, a boot is provided for attaching a geosynthetic layer to a vertical member in a soil, where the geosynthetic layer extends substantially horizontally outwardly from the vertical member. The boot includes a stack of flexible rings. Each ring has an inner edge defining a center opening larger than the horizontal cross section of the vertical member and an outer edge, and is secured around its inner edge to the inner edge of a ring adjacent one side and around its outer edge to the outer edge of a ring adjacent its other side. The bottom ring of the stack of rings is adapted to secure to the geosynthetic layer. A securement ring is secured around the top ring of the stack of rings and has a center opening adapted to be secured to the vertical member.

In another form of this aspect of the present invention, the vertical member is a pile cap.

In yet another form of this aspect of the present invention, the securement ring is attached to the sides of the vertical member. In a further form, a batten is provided for securing the securement ring to the vertical member sides.

In still another form of this aspect of the present invention, the securement ring includes an inner portion adapted to be oriented vertically against the sides of the vertical member. In a further form, a batten secures the inner portion of the securement ring against the vertical member sides.

According to another form of this aspect of the present invention, the vertical member is a vent pipe on a landfill cap.

According to still another form of this aspect of the present invention, the secured together ring edges are thermally welded together. In a further form, each of the flexible rings are geomembranes.

According to yet another form of this aspect of the present invention, the rings of the stack of rings are circular and substantially concentric.

According to still another form of this aspect of the present invention, the rings of the stack of rings are substantially rectangular.

In another aspect of the present invention, an earthen structure is provided, including at least one vertical member extending through the earthen structure and at least one stack of flexible rings substantially at a depth in the earthen structure and disposed around the at least one vertical member. Each ring has an inner edge defining a center opening larger than the horizontal cross section of the at least one vertical member, and an outer edge, and is secured around its inner edge to the inner edge of a ring adjacent one side and secured around its outer edge to the outer edge of a ring adjacent its other side. A geosynthetic layer is buried substantially at the depth in the earthen structure and has at least one opening therein through which the at least one vertical member extends and is secured to the bottom ring of the at least one stack of flexible rings. A securement ring is secured around the top ring of the at least one stack of rings and includes a center opening secured to the at least one vertical member.

In one form of this aspect of the present invention, the at least one vertical member is a plurality of the vertical members and the at least one stack of flexible rings is a plurality of the stacks of flexible rings, where each stack has its top ring secured to one of a plurality of securement rings with the securement rings each having a center opening secured to the sides of the associated ones of the vertical member, and its bottom ring secured to the geosynthetic layer.

In another form of this aspect of the present invention, the vertical member is a pile cap.

In yet another form of this aspect of the present invention, a batten is provided for securing the securement ring to the vertical member sides.

In still another form of this aspect of the present invention, the securement ring includes an inner portion adapted to be oriented vertically against the sides of the vertical member. In a further form, a batten secures the inner portion of the securement ring against the vertical member sides.

According to another form of this aspect of the present invention, the earthen structure is a landfill and the vertical member is a vent pipe on a landfill cap.

According to still another form of this aspect of the present invention, the secured together ring edges are thermally welded together. In a further form, each of the flexible rings are geomembranes.

According to yet another form of this aspect of the present invention, the rings of the stack of rings are circular and substantially concentric.

According to still another form of this aspect of the present invention, the rings of the stack of rings are substantially rectangular.

DETAILED DESCRIPTION OF THE INVENTION

Figure 1:
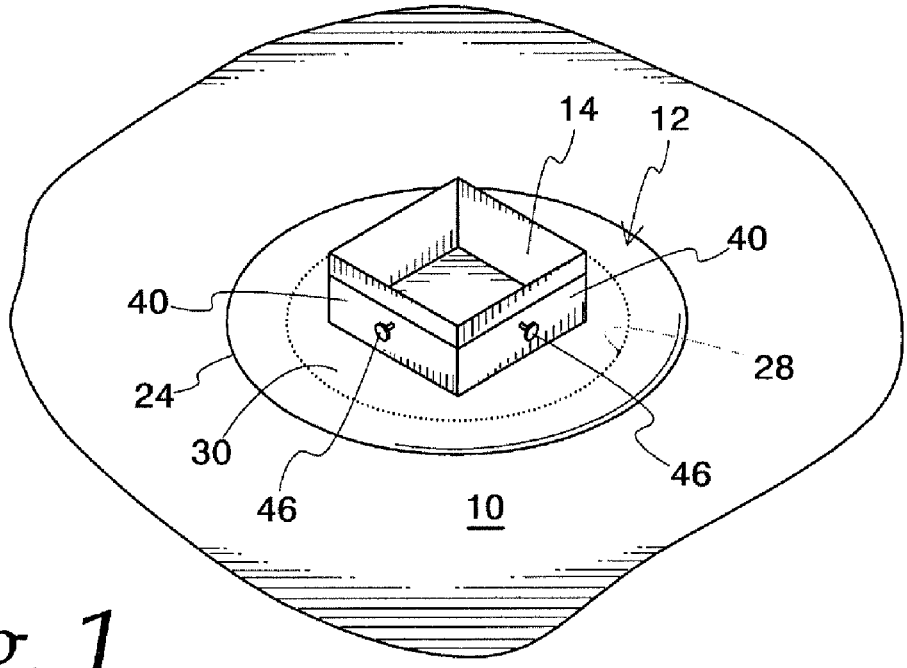
FIG. 1 is a perspective view showing a boot according to the present invention secured to a geomembrane and a vertical member.

A geosynthetic layer (such as a geomembrane) 10 with a boot 12 according to the present invention for attaching to a vertical member 14 in a soil 18 is shown in the Figures.

Specifically, the boot 12 according to the present invention may be advantageously used with substantially any geomembrane 10, with the selection of the geomembrane for a particular earthen structure being dependent on the design of that structure.

In common installations, a geomembrane 10 will be laid so as to extend substantially horizontally on top of an earthen layer and then covered with another earthen layer, with geomembranes 10 successively located between layers. It should be appreciated, however, that the present invention may be advantageously used in any application where settlement or movement is anticipated at some time after installation of the geosynthetic layer.

Where the earthen structure includes vertical members 14 such as pile caps or ventilation pipes (e.g., to facilitate flow of leachate/liquid within the landfill, or to vent gases from a landfill), the geomembrane 10 includes a boot 12 which, according to the present invention, will advantageously secure to the vertical member 14 in a manner which will seal against undesirable leakage gaps in the area of the vertical member and will maintain such a desirable seal over long periods of time notwithstanding shifting of the earth in the structure relative to the vertical member 14. It should be appreciated, however, that the present invention may also be advantageously used with virtually any vertical member, including manholes, leachate piping, utility piping and conduit, light pole bases or foundations, etc.

In accordance with the present invention, the boot 12 includes a stack of flexible rings 20. In the embodiment illustrated in the Figures, there are four rings 20, though it should be appreciated that at least some advantages of the present invention could be obtained with as few as two rings 20. The rings 20 may advantageously be of a geomembrane material.

Figure 5:
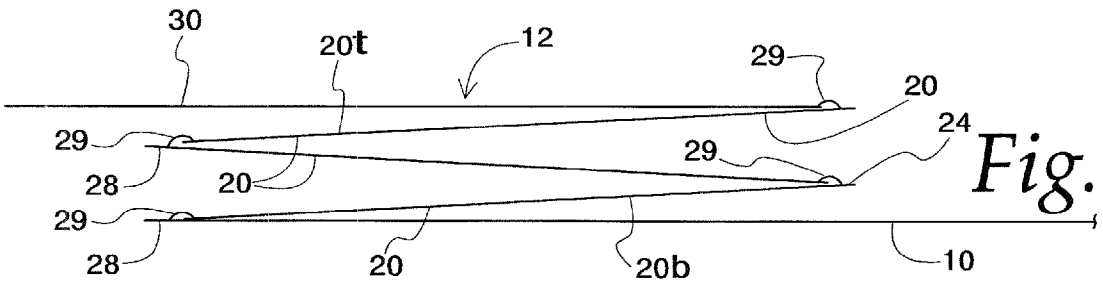
FIG. 5 is a side cross-sectional view showing the attachment of the rings of the boot.

Each ring 20 has an outer edge portion 24 and an inner edge portion 28, with the inner edge portion 28 defining a center opening larger than the horizontal cross section of said vertical member 14. The inner edge portion 28 of each ring 20 is suitably secured to the inner edge portion 28 of a ring 20 adjacent one (top or bottom) side and also suitably secured around its outer edge portion 24 to the outer edge portion 24 of a ring 20 adjacent its other (bottom or top) side. Such connection can be by suitable thermal weld 29 as shown in FIG. 5 (e.g., extrusion, fusion, impulse RF, ultrasonic, etc.), or may also be by other suitable connections (e.g., adhesive, chemical, etc.) or suitable configurations (e.g., a seamless molded part and/or folded layers).

In the advantageous orientation shown in the Figures, the bottom ring 20*b* of the stack of rings 20 is adapted to secure to the geomembrane 10, and a securement ring 30 is secured around the top ring 20*t* of said stack of rings 20. The securement ring 30 has a center opening 34 suitably sized and shaped so that it may be secured to the sides of the vertical member 14, for example, by a batten 40. The securement ring 30 includes an inner portion 44 adapted to be oriented vertically against the sides of the vertical member, whereby the batten 40 may be suitably secured (e.g., by screws 46) to the vertical member with the securement ring inner portion 44 trapped therebetween. It should be appreciated, however, that with the broad scope of the invention the securement may be by any suitable structure, including a PolyLock embedment strip, welding directly to a pipe, adhesive bonding, chemical bonding, etc. Further, it should be appreciated that the securement ring 30 may be secured to a horizontal surface around the vertical member (e.g., a ledge at a location along its height, or a top surface).

As illustrated, the rings 20 may advantageously be circular and substantially concentric, and the securement ring 30 may have a center opening 34 suited for, or adaptable to, the shape over the vertical member 14. However, it should be appreciated that the rings may also have a variety of shapes suitable to surround the vertical member 14, including, for example, square.

Figure 2:
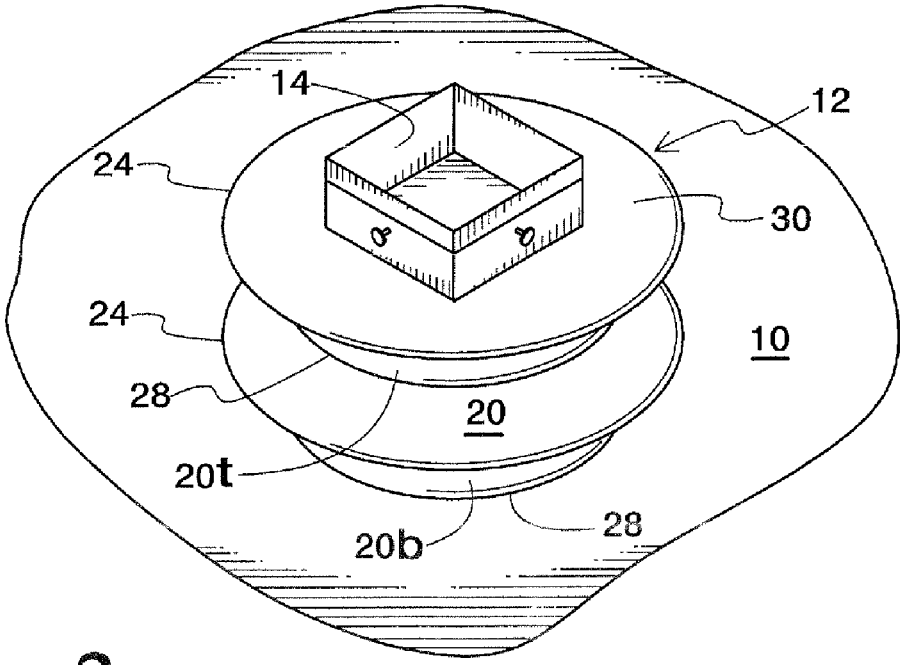
FIG. 2 is a perspective view similar to FIG. 1 showing the boot expanded with the geomembrane shifted downwardly relative to the vertical member.
Figure 3:
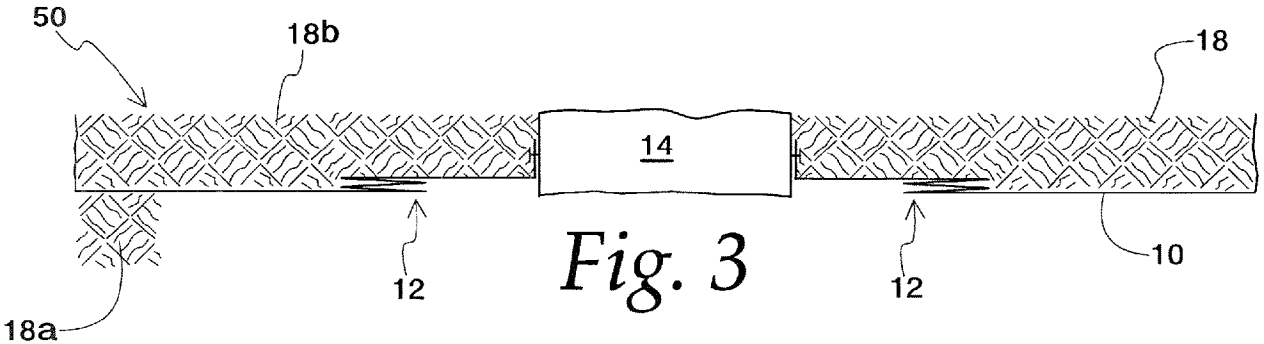
FIG. 3 is a partial cross-sectional view showing an earthen structure with a geomembrane attached to a vertical member by the boot of FIG. 1.
Figure 4:
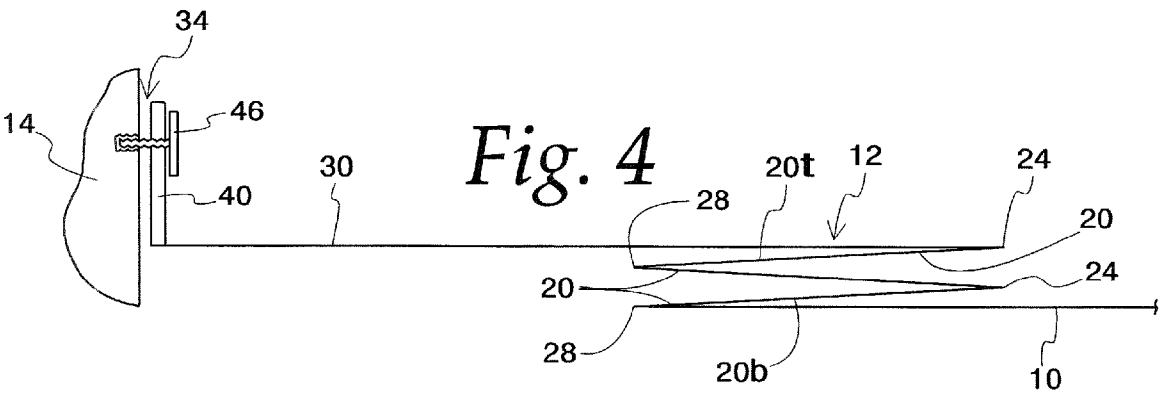
FIG. 4 is a side cross-sectional view showing the attachment of the FIG. 1 boot to the vertical member.

As illustrated in FIG. 3, boots 12 according to the present invention may be advantageously used in an earthen structure 50 having at least one vertical member 14 (e.g., vent pipe), with the geomembrane 10 on top of one layer of soil or other material 18*a*, with additional material 18*b* on top of the geomembrane 10 whereby the geomembrane 10 is buried at a certain depth in the earthen structure 50. It should thus be appreciated that when the material 18 of the structure 50 and the vertical members 14 shift relative to one another over time, rather than tear the boots 12 from their secure, leak-preventing attachment, that attachment will remain and the boot 12 may expand in a vertical direction such as shown in FIG. 2 to accommodate such shifting.

It should be appreciated that reference to top and bottom is made herein for convenience, and that the boot 12 may be oriented oppositely (e.g., so as to be expandable downwardly beneath the geomembrane 10) depending, for example, on an expected direction of relative shifting or for convenience of fabrication or installation (e.g., if it is expected that the vertical member 14 would most likely shift down relative to the geomembrane 10, then the inverted orientation with the securement ring at the bottom could be advantageously used). Thus, it should be understood that references herein to vertical directions and orientations (such as top and bottom) in the specification and also in the claims are intended to encompass both the conventionally understood meaning as well as the opposite, inverted orientation.

Additionally, it should be appreciated that two boots 12 could be used, one extending above the geomembrane 10 and the other extending below the geomembrane 10, to most advantageously accommodate relative shifting in either direction.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A boot for attaching a geosynthetic layer to a vertical member centered on a vertical axis, said geosynthetic layer extending substantially horizontally outwardly from said vertical member, comprising:

a stack of flexible rings, each ring having an inner edge defining a center opening having a first radius larger than the horizontal cross section of said vertical member, said center opening being circular and said first radius being greater than the radial distance of the portion of the vertical member spaced furthest from the vertical axis, having an outer edge with a second radius greater than the first radius, and secured around its inner edge to the inner edge of a ring adjacent one side and secured around its outer edge to the outer edge of a ring adjacent its other side, whereby the bottom ring of said stack of rings is adapted to secure to the geosynthetic layer; and a securement ring secured around the top ring of said stack of rings, said securement ring having a center opening adapted to be secured to said vertical member.

2. The boot of claim 1, wherein said vertical member is a pile cap.

3. The boot of claim 1, wherein said securement ring is secured to the sides of the vertical member.

4. The boot of claim 3, further comprising a batten for securing the securement ring to the vertical member sides.

5. The boot of claim 1, wherein said securement ring includes an inner portion adapted to be oriented vertically against the sides of said vertical member.

6. The boot of claim 5, further comprising a batten for securing the inner portion of the securement ring against the vertical member sides.

7. The boot of claim 1, wherein said vertical member is a vent pipe on a landfill cap.

8. The boot of claim 1, wherein said secured together ring edges are thermally welded together.

9. The boot of claim 8, wherein each of said flexible rings are geomembranes.

10. The boot of claim 1, wherein said rings of said stack of rings are circular and substantially concentric.

11. An earthen structure, comprising:

at least one non-cylindrical vertical member centered on a vertical axis and extending through the earthen structure;

at least one stack of flexible rings substantially at a depth in said earthen structure and disposed around said at least one vertical member, each ring having an inner edge defining a center opening having a first radius larger than the horizontal cross section of said at least one vertical member, said center opening being circular and said first radius being greater than the radial distance of the portion of the vertical member spaced furthest from the vertical axis, and having an outer edge with a second radius greater than the first radius, and secured around its inner edge to the inner edge of a ring adjacent one side and secured around its outer edge to the outer edge of a ring adjacent its other side;

a geosynthetic layer buried substantially at said depth in said earthen structure, said geosynthetic layer having at least one opening therein through which said at least one vertical member extends and secured to the bottom ring of said at least one stack of flexible rings; and a securement ring secured around the top ring of said at least one stack of rings and including a center opening secured to at least one vertical member.

12. The earthen structure of claim 11, further comprising:

said at least one vertical member is a plurality of said vertical members;

said at least one stack of flexible rings is a plurality of said stacks of flexible rings, each stack having its top ring secured to one of a plurality of securement rings with said securement rings each having a center opening secured to the sides of the associated ones of said vertical member, and its bottom ring secured to said geosynthetic layer.

13. The earthen structure of claim 11, wherein said vertical member is a pile cap.

14. The earthen structure of claim 11, further comprising a batten for securing the securement ring to the vertical member sides.

15. The earthen structure of claim 11, wherein said securement ring includes an inner portion adapted to be oriented vertically against the sides of said vertical member.

16. The earthen structure of claim 15, further comprising a batten for securing the inner portion of the securement ring against the vertical member sides.

17. The earthen structure of claim 11, wherein said earthen structure is a landfill and said vertical member is a vent pipe on a landfill cap.

18. The earthen structure of claim 11, wherein said secured together ring edges are thermally welded together.

19. The earthen structure of claim 18, wherein each of said flexible rings are geomembranes.

20. The earthen structure of claim 11, wherein said rings of said stack of rings are circular and substantially concentric.

* * * * *